United States Patent [19]

Rohner

[11] 4,120,526

[45] Oct. 17, 1978

[54] APPARATUS FOR TRANSPORTING COIL CORES

[75] Inventor: Joachim Rohner, Mönchen-Gladbach, Germany

[73] Assignee: W. Schlafhorst & Co., Mönchen-Gladbach, Germany

[21] Appl. No.: 742,110

[22] Filed: Nov. 16, 1976

[30] Foreign Application Priority Data

Nov. 18, 1975 [DE] Fed. Rep. of Germany ..... 2551679

[51] Int. Cl.[2] ..... B66C 1/46; D01H 9/08

[52] U.S. Cl. ..... 294/87 R; 57/52; 242/130.2

[58] Field of Search ..... 294/63 R, 63 A, 86 R, 294/87 R, 87.26, 88, 90, 93, 99 R; 242/35.5 A, 72 R, 72 B, 130, 130.2, 134; 57/52, 53

[56] References Cited

U.S. PATENT DOCUMENTS

| | | | |
|---|---|---|---|
| 2,203,799 | 6/1940 | Shaffer | 294/93 X |
| 2,771,204 | 11/1956 | McCormick | 294/63 R X |
| 2,784,997 | 3/1957 | Baumann | 294/87 R X |
| 2,863,579 | 12/1958 | Meyer | 294/87 R X |
| 3,171,681 | 3/1965 | Roller | 294/90 X |
| 3,667,204 | 6/1972 | Burgermeister et al. | 57/52 |

FOREIGN PATENT DOCUMENTS

| | | | |
|---|---|---|---|
| 1,427,067 | 4/1973 | United Kingdom | 294/63 A |
| 363,595 | 3/1973 | U.S.S.R. | 294/63 A |

*Primary Examiner*—Johnny D. Cherry
*Attorney, Agent, or Firm*—Herbert L. Lerner

[57] ABSTRACT

Apparatus for jointly transporting wound or unwound coil cores of a textile machine having a multiplicity of work stations includes a centrally controllable beam disposed alongside the textile machine, a multiplicity of engageable and disengageable clamping elements fastened to the beam in direction of alignment thereof, the clamping elements being staggered with respect to a given mutual spacing of the work stations along the beam, each of the clamping elements being disposed so as to be effective in two opposite directions for engaging the ends of two adjacent coil cores, respectively.

12 Claims, 6 Drawing Figures

APPARATUS FOR TRANSPORTING COIL CORES

The invention relates to apparatus for jointly transporting wound or unwound coil cores of a textile machine, especially a twisting or spinning frame, formed of a multiplicity of work stations, by means of a centrally controlled beam or carrier that extends alongside the textile machine.

Gripping devices, for example, are provided in heretofore known apparatus of this general type. Each gripping device is associated in that case only with a given work station. In another heretofore known apparatus, a single pneumatic clamping element is provided for a multiplicity of work stations of the textile machine. In the first-mentioned case, the coil cores of a work station can no longer be transported if the gripper of that work station fails. In the other case, breaks in the elastic parts of the pneumatic devices occur here and there quite unavoidably, leading each time to the failure or breakdown of the entire machine.

It is accordingly an object of the invention to provide apparatus for transporting coil cores which avoids the aforementioned disadvantages of the heretofore known apparatus of this general type and to ensure reliable trouble-free joint transport of wound or unwound coil cores of a textile machine.

With the foregoing and other objects in view, there is provided, in accordance with the invention, an apparatus for jointly transporting wound or unwound coil cores of a textile machine having a multiplicity of work stations comprising a centrally controllable beam disposed alongside the textile machine, a multiplicity of engageable and disengageable clamping elements fastened to the beam in direction of alignment thereof, the clamping elements being staggered with respect to a given mutual spacing of the work stations along the beam, each of the clamping elements being disposed so as to be effective in two opposite directions for engaging the ends of two adjacent coil cores, respectively.

With the foregoing disposition of the clamping elements according to the invention, two clamping elements act in the clamping position on the individual coil core from two opposite sides so that even in the event of failure of a single clamping element all of the coil cores can nevertheless be transported without interruption. In accordance with another feature of the invention, each clamping element comprises a housing connected to the beam and one or two clamping members movably mounted in the housing.

In accordance with a further feature of the invention, the clamping member comprises an inflatable tube formed of elastically expansible material and protruding from a pair of opposite sides of the housing. In the clamping position, one end of the tube, which is subjected to overpressure or excess pressure, partly embraces the end of the coil core of the one work station, while the other end of the tube likewise embraces the end of the coil core of the adjacent work station.

In accordance with an added feature of the invention, the clamping element includes two of the clamping members disposed in the housing, each thereof comprising a piston slidably displaceably mounted in the housing at opposite ends thereof and an elastic cushion secured to the respective piston, the cushion, in clamping position of the clamping member, partly embracing an end of a coil core.

In accordance with an additional feature of the invention, and so that the pistons cannot slide out of the housings unintentionally, stops for the clamping members are provided at the ends of the housing.

In the case where the clamping member comprises an inflatable tube, in accordance with another advantageous feature of the invention, the tube has a connecting piece extending through the housing and being connectible to a fluid source.

In the case where the clamping members have a piston with a cushion, the housing is advantageously connected to a fluid supply line. The fluid supply line may be a line for liquid or gaseous media as desired.

In accordance with yet another feature of the invention, the fluid supply line forms at least part of the beam, is connected to the beam and statically cooperates with the beam, or even constitutes the entire beam per se.

In accordance with yet a further feature of the invention, means are provided for centrally controlling the pressure in the fluid line, for example, by providing a suitable flow control valve in the line at a central location. In this case, the clamping members can be pressed against the coil cores, on the one hand, by overpressure or excess pressure and, on the other hand, by spring pressure. In the first case, the two pistons of the clamping members are advantageously connected to each other by a tension spring and in the second case, by a compression spring. The clamping members are restored to the original position thereof in the first case by the tension spring and in the second case, by underpressure in the fluid supply line.

One can also dispense entirely with a fluid supply line if, in accordance with an alternate embodiment of the invention, the pistons of the two clamping members of the clamping element are disposed so that, by means of a linkage system connected to both of the pistons, the latter are shiftable or movable in opposite directions by the linkage system. This may be, for example, a double toggle arrangement which is rotatable about a central shaft.

In accordance with another feature of the invention, the apparatus includes a rod extending along the beam and connected to the linkage systems of all of the clamping members, the rod being shiftable for simultaneously actuating all of the linkage systems. This can be accomplished, for example, by providing respective cranks articulatingly connected to the rod and rigidly connected to the shafts of the clamping elements.

In the case of coil cores that have open ends, a further advantage of the invention is realizable, by providing the beam with centering mandrels which fit into the respective interior of the open-ended coil cores. Gripping of the coil cores is facilitated by the centering mandrels. In addition, specific advantages are derived in the case where a clamping element fails or breaks down due to some distances. The clamping members of the adjacent clamping elements need not then travel the somewhat longer distance which is necessary to place the coil core against the clamping members of the failed or broken-down clamping element, but rather, a shorter distance only until the inner wall of the coil rests against the centering mandrel.

The advantages attained with the invention are, in particular that the transporting operation continues undisturbed also if one or even several clamping elements fail and, moreover, the energy lines can be constructed as stable or durable pipelines susceptible minimally to disturbances or as mechanically operating linkages. In normal, undisturbed operation, automatic centering is advantageously attained, free of canting or tilting and, thereby, a straightly oriented positioning of the transported wound or unwound coil cores. Consequently, an erroneous deposit of the coil cores which, during otherwise undisturbed operation of heretofore known transport apparatus, can nevertheless be expected because of the danger of canting or tilting, is actually impossible with the transport apparatus of the invention.

It should be mentioned especially as being advantageous that the coil cores are held securely and firmly during transport due to the fact that the core ends are partially embraced by the cushions. This applies also to the transport of coil cores formed of less firm material.

It is also believed to be readily apparent that the invention of the instant application is applicable, to the same advantage, to coil cores with open and closed core ends.

Other features which are considered as characteristic for the invention are set forth in the appended claims.

Although the invention is illustrated and described herein as embodied in apparatus for transporting coil cores, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
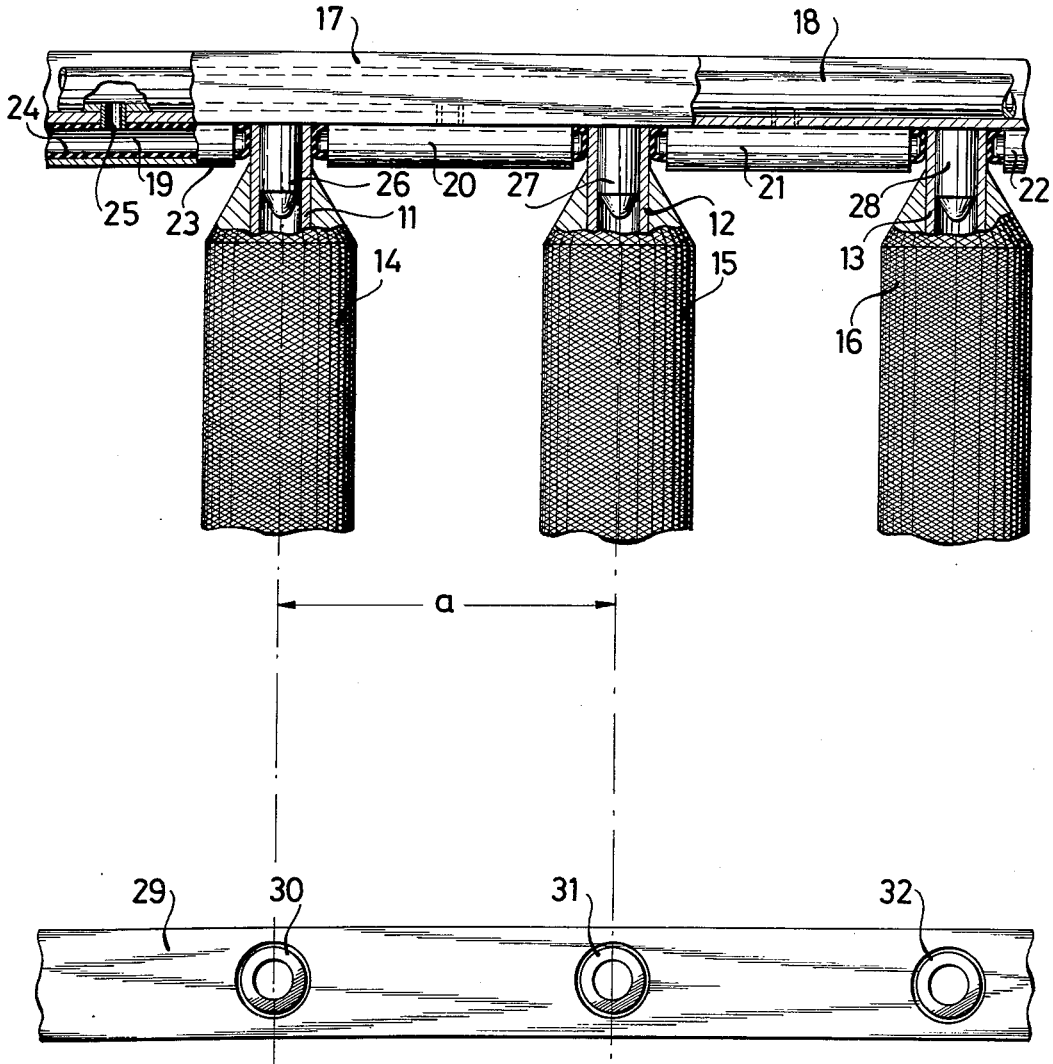
FIG. 1 is a diagrammatic front elevational view, partly broken away, of a section of the apparatus according to the invention, details of special interest being shown in cross section.
Figure 2:
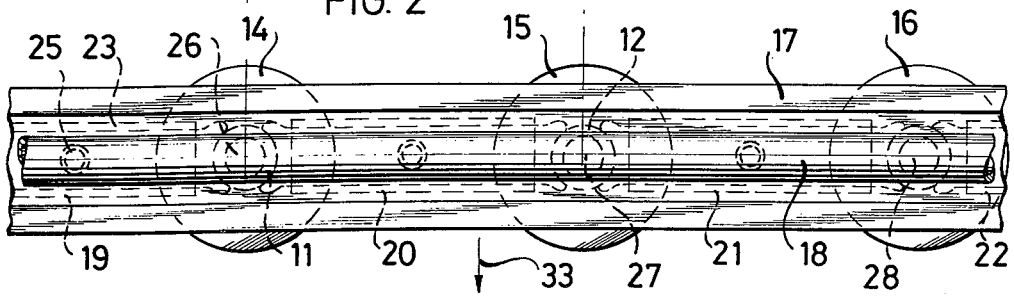
FIG. 2 is a top plan view of FIG. 1 and, simultaneously, of wound coil cores and unwound coil cores of three work stations of a textile machine held in reverse or readiness position.
Figure 3:
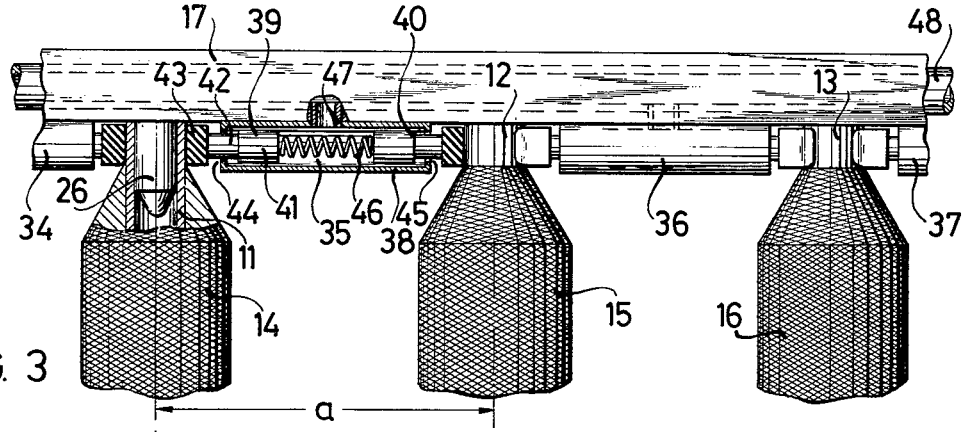
Figure 4:
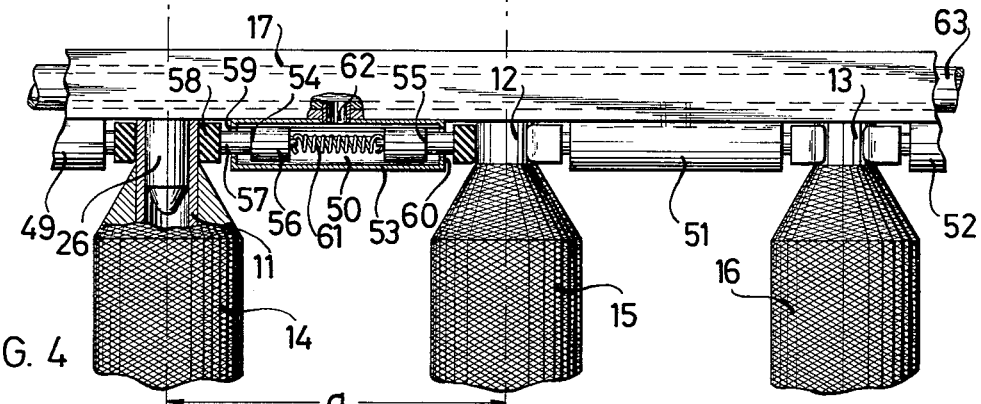
Figure 5:
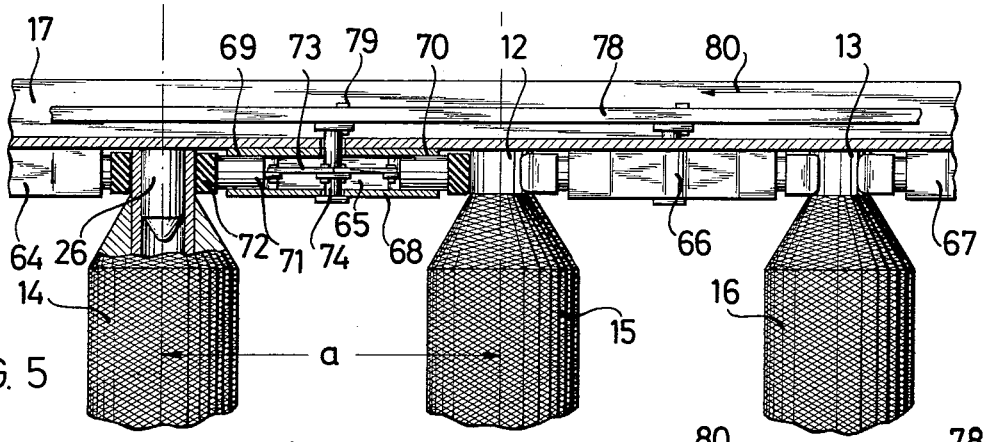
Figure 6:
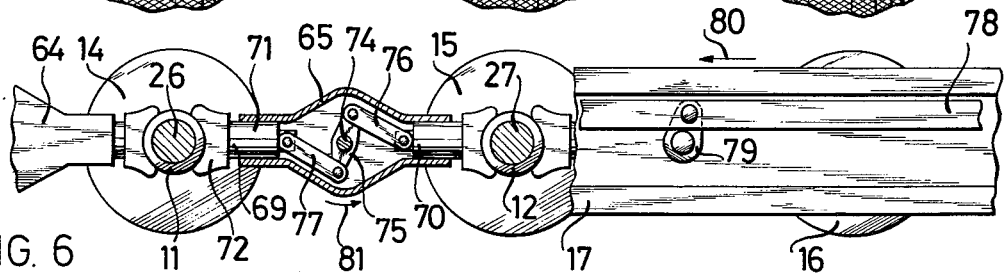

FIGS. 3 and 4 are views similar to that of FIG. 1 of two further embodiments of the invention; and FIGS. 5 and 6 are respective views similar to those of FIGS. 1 and 2 of yet another embodiment of the invention.

Referring now to the drawing and, first, particularly to FIG. 1 thereof, there are shown three wound coil cores or tubes 11, 12 and 13, which are provided with respective windings 14, 15 and 16. Each wound coil core 11, 12 and 13 belongs to a separate work station of an otherwise non-illustrated textile machine, for example, a spinning frame. The work stations and, accordingly, also the wound coil cores are disposed in a straight line spaced a distance or division *a* from one another.

Above the coil cores 11, 12 and 13, centrally controlled carrier or beam 17 is disposed. The beam 17 is movable upwardly, downwardly, perpendicularly to the plane of the drawing and, if desired, also laterally by means of a non-illustrated conventional central control. A fluid line 18 is connected to the beam 17, statically participating in the function thereof as will be described more fully hereinafter.

Clamping elements 19, 20, 21 and 22 are attached to the beam 17. The clamping elements 19 to 22 are staggered or offset with respect to the spacing of the work stations in the direction of alignment of the beam 17. Each clamping element 19 to 22 has a housing 23 and an inflatable tube 24 of elastically expansible material which serves as the clamping member and protrudes from the housing 23 on two opposite sides thereof. Each tube 24 has a connecting piece 25 passing through the housing 23 for connecting with the fluid line 18. By varying the pressure in the fluid line 18, all of the clamping elements 19 to 22 can be activated or deactivated by central control.

In FIG. 1, there are also shown centering mandrels 26, 27 and 28 which are fastened to the beam 17 with the divisions or mutual spacings *a* and fitting into the interior of the hollow coil cores 11, 12 and 13. The beam 17 has been lowered onto the wound coil cores 11, 12 and 13, the centering mandrels 26 to 28 having passed into the interior of the respective coil cores 14 to 16.

The clamping elements 19, 20 and 21 are shown in clamping positions; overpressure or excess pressure thus prevails inside the fluid line 18.

FIG. 2 shows the hereinbefore described parts in a top plan view. Further seen in FIG. 2, are unwound coil cores 30, 31 and 32 which are disposed on a conveyer belt 29 and are in reserve or ready position.

Starting with the clamping position shown in FIGS. 1 and 2, the beam 17 executes sequentially the following centrally controlled movements:

A. The beam 17 is vertically raised, the clamping pieces taking with them all of the wound coil cores and pulling them, if necessary, from non-illustrated mandrels or arbors.

B. The beam 17 is moved in the direction of the arrow 33, all of the wound core coils being transported on the same direction. At the end of this motion phase, the internal pressure of the fluid line 18 is reduced sufficiently so that the clamping elements 19 to 22 become ineffective and the coil cores 14 to 16 fall into a non-illustrated collecting device.

C. The beam is moved in direction opposite to that of the arrow 33 until the centering mandrels 26, 27 and 28 are located vertically above the respective unwound coil cores 30, 31 and 32.

D. The beam 17 is lowered vertically until it is suspended above the unwound coil cores 30 to 32 with very little spacing therebetween. At the end of this motion phase, the pressure in the fluid line 18 is again increased, so that the clamping elements 19 to 22 become effective again and clamp and hold the upper ends of the coil cores 30, 31 and 32.

E. The beam 17 is raised vertically, the clamping members 19 to 22 entraining the previously gripped empty coil cores 30 to 32 and pulling them, if necessary, from non-illustrated arbors or mandrels.

F. The beam 17 is moved in direction of the arrow 33 until the transported empty coil cores 30 to 32 are suspended above the arbors or mandrels or other receiving devices of the work stations. At the end of this phase of motion, the internal pressure of the fluid line 18 can be reduced to such an extent that the clamping elements 19 to 22 become ineffective and the unwound coil cores 30 to 32 drop onto the arbors or mandrels or into any other receiving devices.

G. Alternatively, the beam 17 can be initially lowered vertically to avoid a longer fall distance of the coil cores.

H. After the unwound coil cores 30 to 32 are deposited, the beam 17 is run into a rest position which lies outside the range of action of the work positions. For another change of coil cores, the beam 17 is then run again into the position shown in FIGS. 1 and 2.

In the variants or alternate embodiments of the invention shown in FIGS. 3 to 6, the three wound coil cores 11, 12 and 13 with the respective windings 14, 15 and 16 thereof can be seen again. Here, too, each of the wound coil cores 11, 12 and 13 belongs to a separate work station of the textile machine. The work stations and, accordingly, also the wound coil cores are disposed in a straight line mutually spaced-apart a distance *a*. Also, the centrally controlled beam 17, which is located above the coil cores, is provided in the same arrangement and is equipped with centering mandrels 26, 27. The rest of the structure thereof, however, differs in important features from that shown in FIGS. 1 and 2. In FIG. 3 there are shown clamping elements 34, 35, 36 and 37, which are fastened to the beam 17. Each clamping element has a housing 38 and two clamping members 39 and 40. Each of the two clamping members 39 and 40 is formed of a piston 41 and an elastic cushion 43 fastened thereto by means of a piston rod 42. At both opposite ends of the housing 38, stops 44 and 45 for the clamping members 39 and 40 are disposed. The two clamping members 39 and 40 are connected to each other by a compression spring 46. Each housing 38 is connected by means of a connecting piece 47 to a fluid line 48, which is firmly connected, to the beam 17 and statically cooperating therewith.

The instant there is underpressure in the fluid line 48, the pistons 41 are drawn inwardly in the housings 38 against the force of the compression spring 46, so that the cushions 43 are lifted away from the coil cores 11, 12 and 13. If normal pressure or even overpressure or excess pressure prevails in the fluid line 48, however, the pistons 41 are forced outwardly, the cushions 43 thereby engaging the coil cores 11, 12 and 13 and, accordingly, partially embracing and clamping the ends of the coil cores 11 to 13.

In the modification according to FIG. 4, clamping elements 49, 50, 51 and 52 are likewise fastened to the beam 17, offset or staggered with respect to the spacing of the work stations.

Each of these clamping elements 49 to 52 has a housing 53, in which two clamping members 54 and 55 are disposed. Each clamping members 54 and 55 is formed of a piston 56 and an elastic cushion 58 fastened thereto by means of a piston rod 57. Here, too, stops 59 and 60 for the clamping members 54 and 55 are disposed at the ends of the housing 53. The two clamping members 54 and 55 are connected to each other by a tension spring 61. Each housing 53 is connected by means of a connecting piece 62 to a fluid line 63, which also in this case is attached to the beam 17 and statically cooperates therewith.

The instant overpressure or excess pressure prevails in the fluid line 63, the pistons 56 are forced outwardly in the housing 53 against the force of the tension spring 61, the cushions 58 resting against the coil cores 11, 12 and 13 and thereby partially embracing and clamping the ends of the coil cores. If, on the other hand, there is normal pressure or even underpressure in the fluid line 63, the pistons 56 are drawn inwardly by the tension spring 61, if necessary aided by underpressure, so that the cushions 58 are lifted off the coil cores 11, 12 and 13.

Also, in the embodiment of the invention according to FIGS. 5 and 6, clamping elements 64, 65, 66 and 67 are attached to the beam 17 offset or staggered with respect to the spacing a of the work stations. Each clamping element 64 to 67 has a housing 68 in which two clamping members 69 and 70 are slidably mounted. Each clamping member 69 and 70 is formed of a piston 71, to which an elastic cushion 72 is directly fastened. Special stops for the clamping pieces are not necessary for this embodiment. The pistons of the two clamping members 69 and 70 of each of the clamping elements 64, 65, 66 and 67 are disposed so that they can be moved in opposite directions by means of a linkage 73. Each linkage 73 is formed of a shaft 74, a double-arm lever 75 fastened to the shaft 74, a strap 76 which connects one end of the lever 75 articulatingly to the piston of the clamping member 70, and a strap 77 which connects the other end of the lever 75 articulating to the piston of the clamping member 69. The shafts 74 are rotatably mounted in bores formed in the beam 17.

The linkage arrangements 73 of all of the clamping elements 64 to 67 can be operated simultaneously by means of a rod 78 which extends alongside the beam 17. This is accomplished by providing the shafts 74 with cranks 79, on which the rod 78 acts if it is moved in the direction of the arrow 80 or in the direction opposite thereto. If the shaft 74 rotates in direction of the arrow 81, the pistons 71 are drawn inwardly so that the cushions 72 are lifted away from the coil cores 11, 12 and 13. If the shaft 74 rotates in the direction opposite to the arrow 81, the cushions 72 are pressed against the coil cores 11 to 13, as shown in FIGS. 5 and 6. Deviating from the illustration, the toggle joints can be straightened and thus secured against resetting.

It is directly evident from the drawings that no centering mandrels are necessary for clamping the coil cores, so that also coil cores with closed core ends can be transported. Should one clamping element or, in the extreme case, every second clamping element fail, centering mandrels for transporting coil cores with open core ends would be helpful in that, for example, a coil core 11 would be clamped between a cushion 72 and a centering mandrel 26. Thus, extensive protection is provided in an advantageous manner against the failure of individual clamping elements, also if the coil cores are made of softer material. As mentioned hereinbefore, the invention is not limited to the embodiments shown and described, since numerous other constructions can be made within the scope of the disclosure of the invention herein.

I claim:

1. Apparatus for jointly transporting wound or unwound coil cores of a textile machine having a multiplicity of work stations comprising a centrally controllable beam disposed alongside the textile machine, a multiplicity of engageable and disengageable clamping elements fastened to said beam in direction of alignment thereof, said clamping elements being disposed offset with respect to a given mutual spacing of the work stations along said beam, each of said clamping elements being disposed so as to be effective in two opposite directions for engaging respective ends of two adjacent coil cores, each of said clamping elements comprising an elongated housing connected to said beam and at least one clamping member movably mounted in said housing.

2. Apparatus according to claim 1 wherein said clamping member comprises an inflatable tube formed of elastically expansible material and protruding axially from a pair of opposite ends of said housing.

3. Apparatus according to claim 2 wherein said tube has a connecting piece extending through said housing and being connectible to a fluid source.

4. Apparatus according to claim 1 including stop means disposed at at least one end of said housing for limiting movement of said clamping member.

5. Apparatus according to claim 1 including centering mandrels carried by said beam for fitting into respective coil cores having a hollow end.

6. Apparatus for jointly transporting wound or unwound coil cores of a textile machine having a multiplicity of work stations comprising a centrally controllable beam disposed alongside the textile machine, a multiplicity of engageable and disengageable clamping elements fastened to said beam in direction of alignment thereof, said clamping elements being disposed offset with respect to a given mutual spacing of the work stations along said beam, each of said clamping elements being disposed so as to be effective in two opposite directions for engaging respective ends of two adjacent coil cores, each of said clamping elements comprising a housing connected to said beam and at least one clamping member movably mounted in said housing, two of said clamping members being disposed in said housing, each thereof comprising a piston slidably displaceably mounted in said housing at opposite ends thereof and an elastic cushion secured to the respective piston, said cushion, in clamping position of said clamping member, partly embracing an end of a coil core.

7. Apparatus according to claim 6 including a fluid supply line connected to said housing.

8. Apparatus according to claim 7 wherein said fluid supply line forms at least part of said beam.

9. Apparatus according to claim 6 including a compression spring connected to both of the pistons of the respective clamping members of the respective clamping elements.

10. Apparatus according to claim 6 including a tension spring connected to both of the pistons of the respective clamping members of the respective clamping elements.

11. Apparatus according to claim 6 including a linkage system connected to both of the pistons of the respective clamping members of the respective clamping elements, said pistons being shiftable in opposite directions by said linkage system.

12. Apparatus according to claim 11 including a rod extending along said beam and connected to the linkage systems of all of said clamping members, said rod being shiftable for simultaneously actuating all of said linkage systems.

* * * * *